US005926985A

United States Patent [19]

Arbuckle

[11] Patent Number: 5,926,985

[45] Date of Patent: Jul. 27, 1999

[54] MEETING MANAGER

[76] Inventor: Garry D. Arbuckle, 1176 Meadowlark Dr., Waterford, Mich. 48327

[21] Appl. No.: 08/456,109

[22] Filed: May 31, 1995

[51] Int. Cl.[6] ..... A47G 7/00

[52] U.S. Cl. ..... 40/657; 40/358; 273/287

[58] Field of Search ..... 40/327, 358, 606, 40/657; 211/14; 312/234.4; 273/282.1, 287, 138.1, 139

[56] References Cited

U.S. PATENT DOCUMENTS 3,073,661 1/1963 Kelling ..... 312/234.4 X 3,442,378 5/1969 Wolfe ..... 40/324 X 3,478,457 11/1969 Watkins ..... 40/324

4,955,485 9/1990 Alton ..... 211/14

*Primary Examiner*—Brian K. Green

*Attorney, Agent, or Firm*—John R. Benefiel

[57] ABSTRACT

A humorous novelty office display item is disclosed, including several lightweight soft foam balls, a flat base with dished receptacles for holding the balls in a spaced array extending along the top of the base, and labels on the base that associate a message with each displayed ball.

6 Claims, 1 Drawing Sheet

MEETING MANAGER

BACKGROUND OF THE INVENTION

This invention relates to a variety of office novelty items such as miniature dartboards, rubber band guns, and miniature basketball/baskets, but this invention can serve the very useful purpose of improving the effectiveness and enjoyment of meetings.

SUMMARY OF THE INVENTION

The preferred embodiment of the present invention comprises a display device that includes a plurality of soft foam balls, a base with cavities for holding the balls arrayed along the base, and labels on the base that associate a message with each ball.

The base comprises a rectangular piece formed with a cavity for each ball being displayed. The diameter of each cavity is less than the diameter of one of the balls, but large enough to keep a ball in a stable position when a ball is resting in one of the cavities. The edges of the base are angled to allow easy reading of the labels that are positioned in front of each ball and adhered to the base.

The display device has particular utility for individuals that wish to improve the effectiveness and enjoyment of their meetings in a good-natured fashion and/or enjoy having and displaying novelty items. The improved meeting effectiveness and enjoyment is achieved when the invention is placed within the reach of all of the participants of a meeting and one meeting participant ("A") believes that another meeting participant ("B") is carrying on a discussion that adds little or no value to the meeting. With good natured intentions and a spirit of team building, meeting participant "A" selects the appropriate ball from the display device and either threatens to toss the ball towards meeting participant "B" or actually does toss the ball in the direction of meeting participant "B". After either gesture is completed, the ball is returned to the display device for future use.

DESCRIPTION OF A PREFERRED EMBODIMENT OF THE INVENTION

Figure 1:
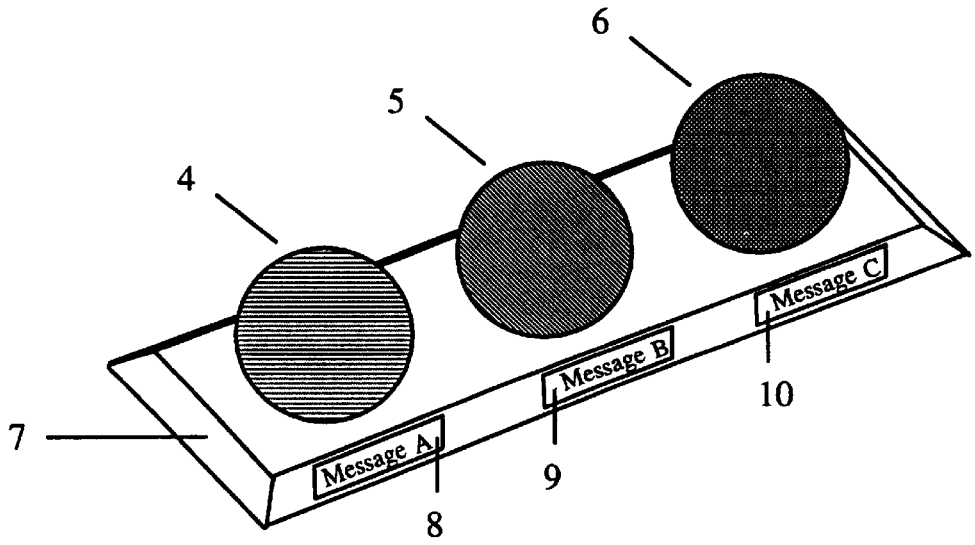
FIG. 1 is a perspective view of the preferred embodiment of the device.
Figure 2:
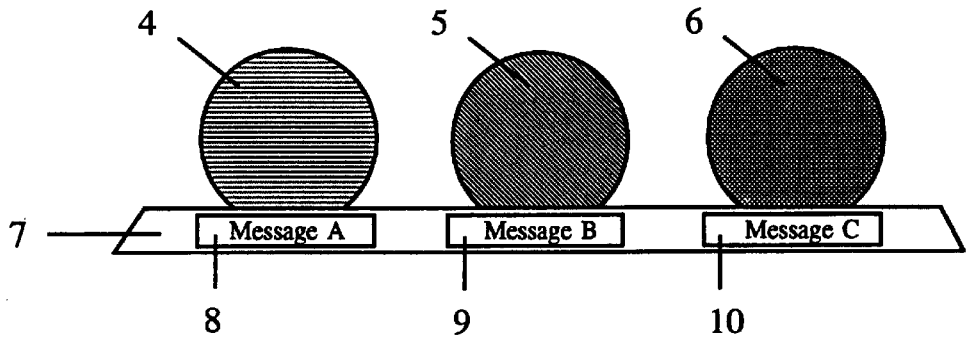
FIG. 2 is a front elevational view of the device.
Figure 3:
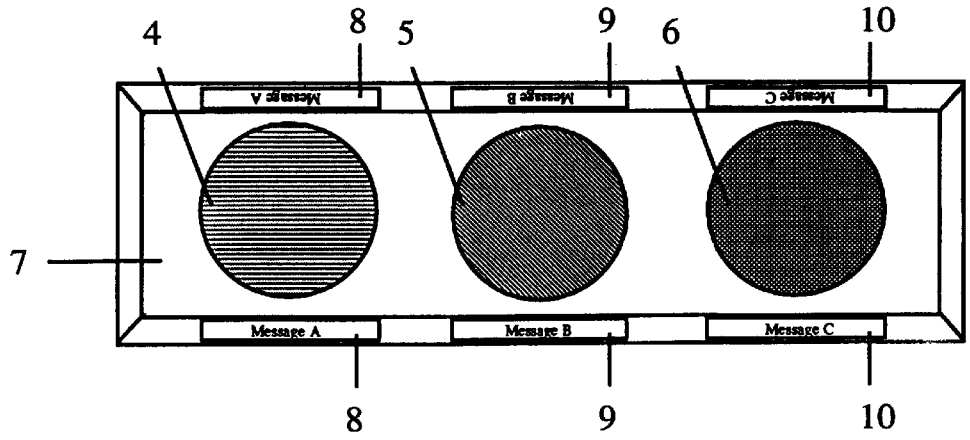
FIG. 3 is a top view of the device.

Referring to the drawings, the preferred device comprises a plurality of balls, i.e., three balls 4, 5, and 6, supported on a base 7 having dished cavities for holding the balls in a spaced array, and labels 8, 9, 10 that associate a message with each ball 4, 5, 6.

The three balls 4, 5, 6 may be formed of a soft foam rubber, or other lightweight, deformable material, with each ball 4, 5, 6 of a different contrasting color. The base may be formed of decoratively carved wood or other suitable material. The labels 8, 9, 10 are formed of paper with a gold foil surface, black lettering, and an adhesive backing. Other suitable material, colors, or methods of attachment to the base 7 can be used for the labels 8, 9, 10. The labels 8, 9, 10 and associated lettering are of sufficient height and length to allow easy reading of the label from a distance of ten feet. The labels 8, 9, 10 are adhered to both sides of the base 7 in a manner that allows individuals on either side of the base to understand the same messages associated with each ball 4, 5, 6. Although a variety of different messages could be used, the preferred massages associated with the three balls include "Times Up!", "What's Your Point?", and "Tangent!".

The base 7 is a rectangular flat piece, and has a length that is greater than the combined diameters of the quantity of balls being displayed. The base has a width and height that can accommodate the quantity and size of dished cavities needed in the base 7 to hold and stabilize the number of balls 4, 5, 6 being placed in the base 7.

The diameter of each cavity is less than the diameter of one of the balls but large enough to keep a ball in a stable position when a ball is resting in one of the cavities. The edges of the base are angled to allow easy reading of labels that are positioned in front of each ball and adhered to both viewing sides of the base.

The balls 4, 5, 6 are held in the base cavities by means of gravity and friction between the balls 4, 5, 6 and base 7. Other suitable methods for holding, stabilizing, and allowing easy removal of the balls 4, 5, 6 could also be used in place of the dished cavities.

Having described my invention, I claim:

1. A novelty display item, comprising;

a plurality of lightweight objects each formed of a soft, foam resilient material;

a decorative, rigid base with an array of object holders each holding a respective object to be displayed;

a label with a different, lettered message positioned under each object, and attached to the base adjacent a respective cavity;

each lettered message of sufficient size and distinctiveness to allow easy reading of the label lettered message from at least a distance of about ten feet.

2. The novelty display according to claim 1 wherein three objects are arrayed on said base, each on a respective holder.

3. The novelty display according to claim 2 wherein said lettered messages comprise, "Times Up", "What's Your Point", and "Tangent", respectively.

4. The novelty display according to claim 1 wherein said objects comprise balls constructed of soft foam rubber and are each of a color contrasting with the color of the other balls.

5. The novelty display according to claim 4 wherein said base object holders comprise dished cavities each having a respective ball resting therein.

6. The novelty display according to claim 1 wherein said labels are affixed on both sides of said base in identical pairs associated with each object.

* * * * *